US005105477A

United States Patent [19]

Golde

[11] Patent Number: 5,105,477

[45] Date of Patent: Apr. 21, 1992

[54] GARMENT WITH PROVISION FOR ARM VENTILATION

[75] Inventor: Paul J. Golde, Mission Viejo, Calif.

[73] Assignee: Intersport Fashions West, Inc., Orange, Calif.

[21] Appl. No.: 656,395

[22] Filed: Feb. 15, 1991

[51] Int. Cl.[5] ..... A41D 1/02

[52] U.S. Cl. ..... 2/93; 2/108; 2/DIG. 1

[58] Field of Search ..... 2/2, 77, 85, 93, 97, 2/108, 115, 125, 270, DIG. 1

[56] References Cited

U.S. PATENT DOCUMENTS

| | | | |
|---|---|---|---|
| 308,244 | 11/1884 | Fishel . | |
| 317,711 | 5/1885 | Brinkmann | 2/DIG. 1 |
| 375,504 | 12/1887 | Norton | 2/DIG. 1 |
| 1,360,390 | 11/1920 | Gilfillan . | |
| 2,010,434 | 8/1935 | Langrock | 2/93 |
| 2,073,711 | 3/1937 | Robinsohn | 2/126 |
| 2,079,980 | 5/1937 | Anders . | |
| 2,084,173 | 6/1937 | Wexler | 2/87 |
| 2,114,514 | 4/1938 | York | 2/93 |
| 2,259,560 | 10/1941 | Glidden | 154/2 |
| 2,391,535 | 12/1945 | Zelano | 2/93 |
| 2,465,286 | 3/1949 | Silver | 2/DIG. 1 |
| 2,700,769 | 2/1955 | Polchinski | 2/93 |
| 2,713,168 | 7/1955 | Bagnato | 2/93 |
| 2,715,226 | 8/1955 | Weiner | 2/79 |
| 2,716,240 | 8/1955 | Trageser | 2/93 |
| 2,825,902 | 3/1958 | Breier | 2/93 |
| 2,989,754 | 6/1961 | Bukspan | 2/87 |
| 3,045,243 | 7/1962 | Lash et al. | 2/1 |
| 3,086,215 | 4/1963 | Di Paola | 2/93 |
| 3,153,793 | 10/1964 | Lepore | 2/93 |
| 3,206,762 | 9/1965 | Smith | 2/93 |
| 3,213,465 | 10/1965 | Ludwikowski | 2/87 |
| 3,710,395 | 1/1973 | Spano et al. | 2/78 |
| 3,761,962 | 10/1973 | Myers | 2/79 |
| 3,921,224 | 11/1975 | Ingram, III | 2/93 |
| 4,185,327 | 1/1980 | Markve | 2/2 |
| 4,408,356 | 10/1983 | Abrams | 2/87 |
| 4,513,451 | 4/1985 | Brown | 2/69 |
| 4,608,715 | 9/1986 | Miller et al. | 2/1 |
| 4,722,099 | 2/1988 | Kratz | 2/115 |
| 4,731,883 | 3/1988 | Foster | 2/DIG. 1 |

FOREIGN PATENT DOCUMENTS

| | | | |
|---|---|---|---|
| 494309 | 7/1950 | Belgium | 2/93 |
| 034518 | 1/1981 | European Pat. Off. . | |
| 150092 | 2/1937 | Fed. Rep. of Germany | 2/93 |
| 1029851 | 3/1953 | France . | |
| 1166636 | 11/1958 | France | 2/DIG. 1 |
| 1220511 | 1/1960 | France | 2/93 |
| 2633493 | 1/1990 | France | 2/2 |
| 2104770 | 3/1983 | United Kingdom | 2/DIG. 1 |

*Primary Examiner*—Werner H. Schroeder
*Assistant Examiner*—Diana L. Biefeld
*Attorney, Agent, or Firm*—Richard F. Carr; Richard L. Gausewitz; Allan Rothenberg

[57] ABSTRACT

A garment is provided which has air scoops adjacent the wrist portions of the sleeves of the garment defined by a longitudinal opening interconnected by an outer web, and an inner web connected to the material of the sleeve at spaced locations on either side of the opening. A flap is included to extend over the outer edge of the scoop when it is not to be used, and which may be secured to the inner layer of the scoop when the scoop is in use. The garment may include an air-pervious lining and a discharge opening on the back of the garment for allowing air received in the scoops to flow along the arms and discharge from the garment.

18 Claims, 3 Drawing Sheets

GARMET WITH PROVISION FOR ARM VENTILATION

BACKGROUND OF THE INVENTION

For certain activities it is advisable for the participant to wear a protective garment to avoid injury in the case of accident. An example of this is in the riding of a motorcycle where a jacket of strong leather material is of great benefit in protecting the rider in the event that the motorcycle is capsized and the rider makes contact with pavement or other surface. Injury from sliding along the pavement thus often is avoided. Such a jacket also may be desirable for sports such as skiing where again the participant may be caused to slide along the surface which could cause burns or other injury.

In warm weather a leather jacket of conventional construction may become almost unbearably hot. This discourages the wearing of the jackets so that protection is lost. An effective way of alleviating this condition is disclosed in U.S. Pat. No. 4,608,715, which relates to a protective garment, such as a jacket, having air inlet openings in the front and discharge openings in the back. Closures, such as zippers, are provided for in these openings, so that in warm weather they may be opened to allow air to circulate through the jacket for cooling the torso of the wearer of the jacket.

Although the garment of U.S. Pat. No. 4,608,715 provides a very efficient means for ventilating the torso region, the arms have remained confined within the leather material of the garment and have had no relief from cooling air. Thus, less than the total space within the garment has been cooled and optimum comfort has not been achieved.

SUMMARY OF THE INVENTION

The present invention overcomes the deficiencies of the prior art, including that of U.S. Pat. No. 4,608,715, providing a garment with a means for ventilating and cooling the arm regions. To this end, air scoops are provided adjacent the outer ends of the sleeves of the garment, receiving ram air which flows through the sleeves to provide cooling.

Each of the air scoops is defined by a longitudinal opening in the sleeve of the garment, extending inwardly from the inner edge of the wrist band. A zipper can close this opening. Another web of flexible air-impervious material extends between the opposite edges of the opening, allowing the opening to be distended. A web of air-permeable material, such as a perforated nylon, is stitched to the sleeve material beneath the outer web at locations spaced on either side of the opening and interconnected at an inner edge that extends around the inner end of the zipper. The forward edge of the sleeve material, between the spaced stitchings for the inner web, is left free. Consequently, when the zipper is opened, air traveling toward the arm can distend the material at the free leading edge and a scoop will be formed as the outer web allows the edges of the opening to separate.

In order to assure a large finite opening at the leading edge of the air scoop, strips of material more rigid than that of the garment material, such as a semi-rigid plastic resembling that which is sometimes used for collar stays, may be secured to the leading edge of the air scoop region.

A flap is provided at the leading edge of the scoop to act as a closure. The flap is provided with snaps which engage snaps on the outer surface of the scoop when the flap overlaps the scoop leading edge to prevent entry of ram air. The flap can be secured to the inner web by additional snaps on the latter element when the scoop is opened so that the flap will not move in response to the flow of air and will not get in the way of air entering the scoop.

DETAILED DESCRIPTION OF THE INVENTION

Figure 1:
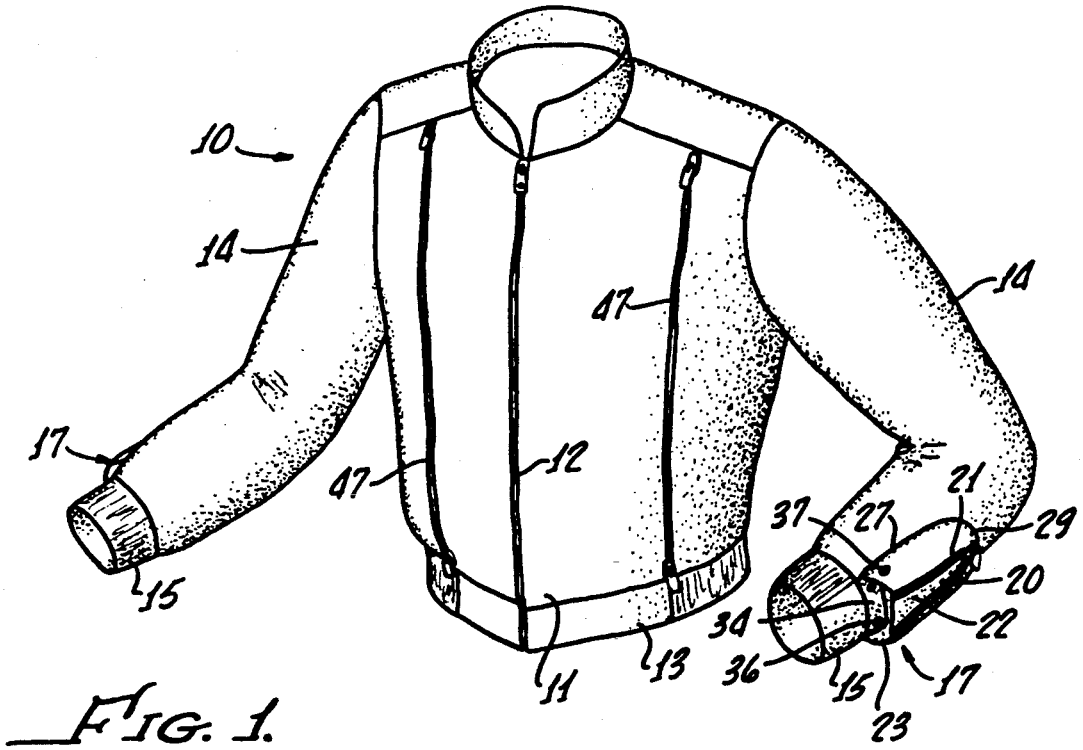
FIG. 1 is a perspective view of a jacket incorporating the invention, as viewed from the front and one side, with the air scoop open.

As illustrated, the invention is incorporated in a motorcycle jacket 10, although it may be applied to the sleeves or other location of a jumpsuit-type garment or to a jacket or other garment intended for skiing or some other activity. Typically, the jacket 10 is made of leather. The jacket 10, in keeping with conventional construction, includes a front panel 11 closed by a zipper 12. Portions of the waistband 13 may be elasticized for a close fit. The sleeves 14 terminate in cuffs 15, parts of which also may be elasticized.

Figure 3:
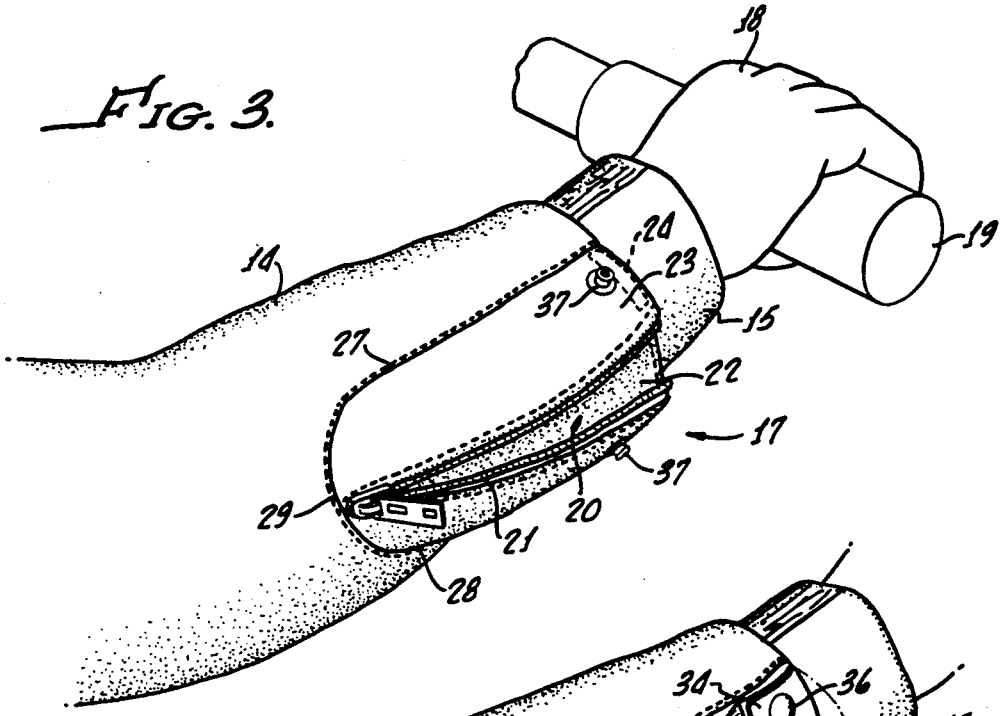
FIG. 3 is an enlarged fragmentary view of one sleeve, as the jacket is used and with the air scoop open.
Figure 4:
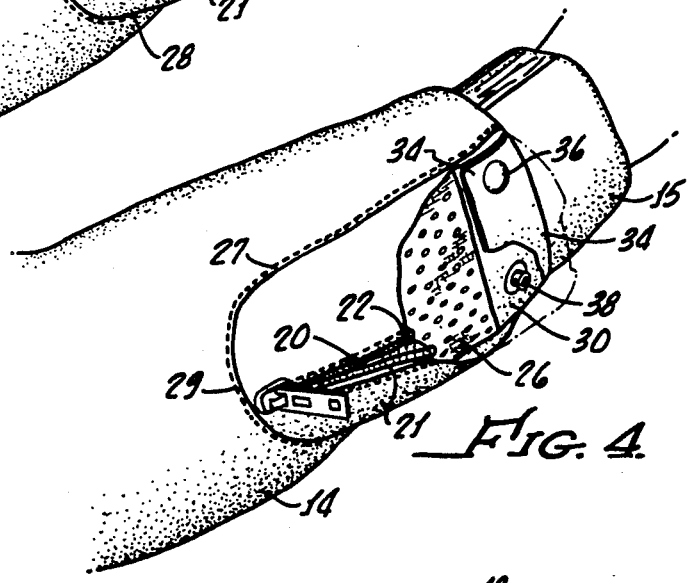
FIG. 4 is a fragmentary view similar to FIG. 3, but with portions of the air scoop broken away.
Figure 5:
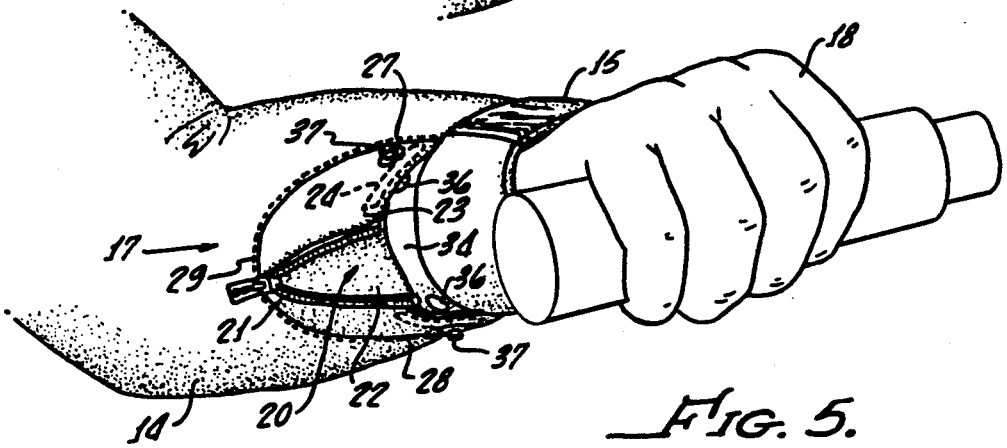
FIG. 5 is a fragmentary view of the arrangement of FIG. 3 as seen from another angle.
Figure 8:
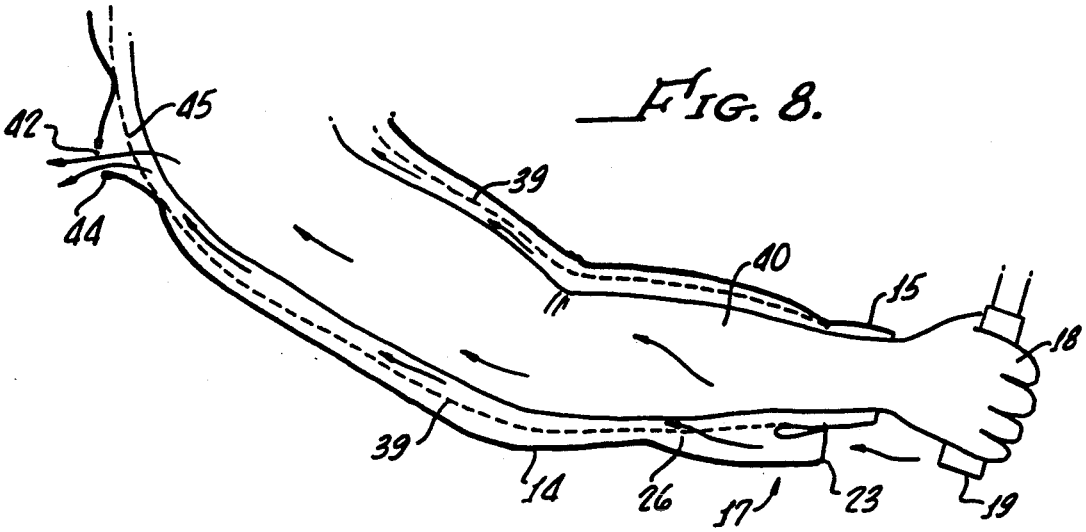
FIG. 8 is a sectional view, partially in elevation, showing the flow of air through the sleeve of the jacket.
Figure 6:
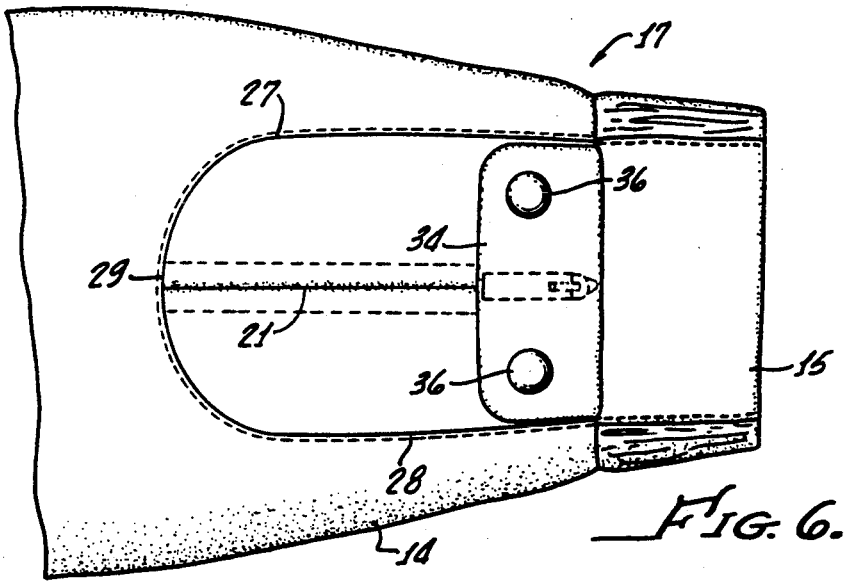
FIG. 6 is an enlarged fragmentary plan view of the sleeve end with the air scoop closed.

A ventilating air scoop 17 is provided on each sleeve adjacent the cuff 15. For a motorcycle jacket, these scoops are positioned on the outside of the wrist area so as to be exposed to a maximum flow of air. For example, when the hand 18 grips the handlebar 19 of a motorcycle, as seen in FIGS. 3, 5 and 8, the scoop 17 will be located outside of the windscreens most commonly used.

Figure 7:
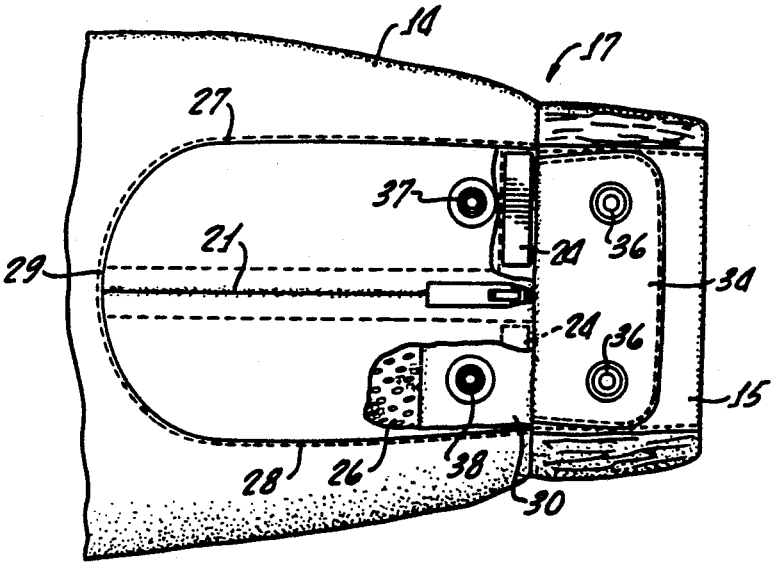
FIG. 7 is a view similar to FIG. 6, but with the closure flap released and portions of the air scoop broken away.

The material of the arm 14 is split for the length of the scoop 17 so as to define an opening 20 which may be closed by a zipper 21. Secured at its edges to the two sections of the zipper 21 is a web 22 that extends the length of the opening 20. The web 22 may be of the same material as that of the outer covering of the jacket, being impervious to the flow of air. The web 22, which is generally triangular, allows the scoop 17 to open as the edges of the opening 20 are spread apart when the zipper 20 is opened. The separation of the edges of the opening 20 is limited by the web 22, and is greatest at the free leading edge 23 because the apical portion of the web 22 is adjacent the inner end of the opening 20. Preferably, in order to assure the formation of a well-defined air scoop opening, strips 24 are stitched into the leading edge 23 of the scoop (see FIG. 7). These strips preferably are of semirigid material, such as that used for collar stays.

As a portion of the scoop assembly, an inner web 26 of perforated fabric, wider than the web 22, is stitched to the underside of the outer air-impervious material of the sleeve. The attachment of the web 26 includes two spaced longitudinal rows of stitches 27 and 28 that extend inwardly from the cuff 15 and are positioned one on either side of the opening 20, and a curved inner row of stitches 29 which joins the inner ends of the stitches 27 and 28. A short strip 30, of the same material as the outer layer of the jacket 10, is connected by stitching to the inner end of the cuff and is attached by stitches to the outer edge of the fabric layer 26. The strip 30 forms an extension of the fabric layer 26.

A rectangular closure flap 34 is secured along one of its longer edges to the sleeve 14 where the strip 30 joins the cuff 15. Snap fasteners 36 are provided on the undersurface of the flap 34. When the air scoop 17 is closed by the closing of the zipper 21, the flap 34 can overlap the leading edge 23 of the scoop and the snaps 36 may be mated with corresponding outwardly facing snaps 37 on the sleeve 14 and between-the rows of stitches 27 and either side of the zipper 21. This assures that the leading edge 24 of the air scoop 17 is closed and that ram air will not enter it.

When the air scoop is to be used, the snaps 36 and 37 are released and the zipper 21 is opened. The flap 34 then is folded inwardly beneath the leading edge 24 to overlap the strip 30. Snaps 38 on the strip 30 are engaged by the snaps 36 of the flap 34, thereby holding the flap 34 down so that it does not move in the wind and cannot obstruct the opening to the scoop 17.

The lining 34 of the jacket 10, including the portion in the sleeves 14 beneath the air scoops 17, is of a perforated material. Therefore, the air that enters the scoop 17 can flow up and along the arm 40 of the wearer of the jacket, keeping the arm cool.

Figure 2:
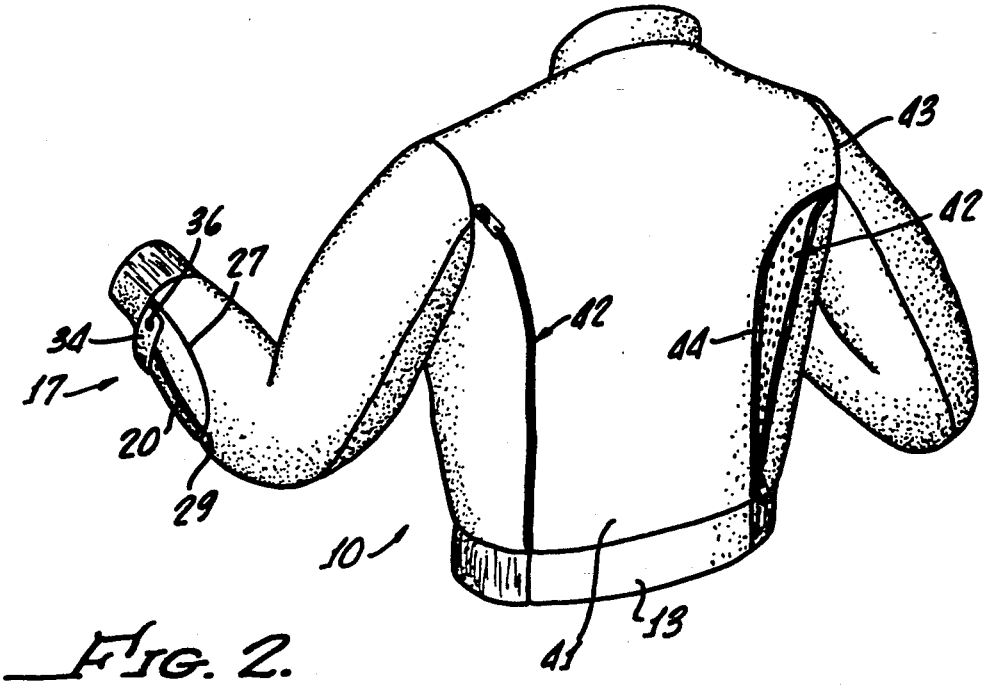
FIG. 2 is a perspective view of the rear of the jacket, as viewed from one side, with the air scoop closed.

The back panel 41 of the jacket 10 may be provided with two air discharge openings 42, as seen in FIG. 2, which are spaced apart and extend generally vertically from the shoulder 43 to the waistband 13. These air outlet openings may be closed by zippers 44. Beneath each zipper 44 is a perforated material 45 of a width sufficient to allow separation of the edges of the openings 42. When the zippers 44 are opened, air can flow through the lining 39 and through the perforated material 45 to discharge at the back of the wearer of the jacket. Hence, there can be a continuous flow of air through the sleeves 14 of the jacket and a ballooning effect of the jacket is avoided.

The jacket also may be provided with air inlet openings 47 in the front panel 11 of the type disclosed in U.S. Pat. No. 4,608,715.

The foregoing detailed description is to be clearly understood as given by way of illustration and example only, the spirit and scope of this invention being limited solely by the appended claims.

What is claimed is:

1. A garment having provision for arm ventilation comprising means of a material generally impervious to the flow of air defining a front garment portion, a back garment portion, and a pair of sleeves projecting from opposite sides of said front and back portions, and means on each of said sleeves defining an air scoop, said means including on each of said sleeves an opening through said material, said opening having opposite edges and extending longitudinally inwardly from the outer end region of the sleeve, closure means for selectively closing said opening, a first flexible web of generally air-impervious material, means connecting opposite edges of said first web to said sleeve adjacent said opposite edges of said opening so that said first web can permit limited separation of said opposite edges of said opening, a second flexible web at least a portion of which is of air-pervious material, and means for attaching said second web to said sleeve at a location on either side of said opening and spaced from said opposite edges of said opening, whereby when said closure is opened the portion of said sleeve between said last-mentioned attaching means can be distended by air traveling relatively toward said sleeve to define an intake scoop to receive said air, and air so received in said scoop can discharge through said second web along the arm of the wearer of said garment.

2. A device as recited in claim 1 in which each of said sleeves includes a wrist portion, said scoop being inwardly of said wrist portion and including a free outer edge, and including means for covering said free outer edge when said closures means is closed, for thereby preventing entry of air.

3. A device as recited in claim 2 in which said first web is wider at said free outer edge than it is inwardly thereof for permitting maximum separation of said opposite edges of said opening at said free outer edge.

4. A device as recited in claim 2 in which for said means for covering said free outer edge a flap is provided adjacent the inner edge of said wrist portion, said flap being extendable over said free outer edge, and including releasable fastener means for holding said flap over said free outer edge.

5. A device as recited in claim 4 in which said second web adjacent said wrist portion is provided with fastener means thereon, and in which said fastener means of said flap can engage said fastener means of said second web for causing said flap to overlie said second web so as to leave said free outer edge unconfined and allow the outer edge of said scoop to open.

6. A device as recited in claim 1 including a strip of material which is more rigid than the material defining said sleeves secured to said free outer edge on either side of said opening to help impart a contour to said leading edge when said closure is opened.

7. A device as recited in claim 1 including means defining a lining in each of said sleeves, said means defining a lining being of air-pervious material, whereby air entering said scoop can flow through said second web and through said lining along the arm of the wearer of said garment.

8. A device as recited in claim 1 including, in addition, means defining at least one discharge opening in the back portion of said garment, whereby air received in said air scoops can pass through said garment and be discharged through said discharge opening.

9. A garment having provision for arm ventilation comprising means of a material generally impervious to the flow of air defining a front garment portion, a back garment portion, and a pair of sleeves projecting from opposite sides of said front and back portions, each of said sleeves having an outer end, said material being split longitudinally from a location adjacent said outer end to a location inwardly thereof so as to define an opening having two opposite edges, a first web of substantially air-impervious material interconnecting said opposite edges for permitting said opposite edges to be separated a limited distance, a second web wider than said first web disposed beneath said first web, means for attaching said second web to the underside of said material defining said sleeve, including an attachment at two locations, one on either side of said opening and spaced therefrom, and extending generally longitudinally of said sleeve from adjacent said outer end to a location inwardly thereof, said material defining said sleeve intermediate said two locations having a free edge adjacent said outer end, and releasable closure means for either holding said opposite edges together or permitting separation of said opposite edges, whereby when said closure means so permits separation of said opposite edges said material defining said sleeve intermediate said two locations can be distended outwardly by air traveling relatively toward said sleeve and can cooperate with said first web to define a scoop for directing said air through said second web and into said sleeve.

10. A device as recited in claim 9 in which said closure means comprises a zipper having a segment extending the length of each of said opposite edges.

11. A device as recited in claim 9 in which said first web is generally triangular with the apex of the triangle being adjacent the inner end of said opening.

12. A device as recited in claim 9 including, in addition, a flap attached to said sleeve adjacent said outer end thereof and arranged so that it can be extended over said free edge for precluding entry of said air beneath said free edge, and means for releasably securing said flap as so extended over said free edge.

13. A device as recited in claim 12 including, in addition, means for selectively securing said flap to said second web, whereby when said closure means so permits separation of said opposite edges said flap will not interfere with entry of said air into said scoop.

14. A device as recited in claim 9 in which said sleeve includes a lining inwardly of said second web, said lining being of air-permeable material for permitting the flow of air along the arm of the wearer of said garment.

15. A garment having provision for ventilation comprising means of a material generally impervious to the flow of air defining a garment and means on said garment defining an air scoop, said means including an opening through said material, said opening having opposite edges, closure means for selectively closing said opening, a first flexible web of generally air-impervious material, means connecting opposite edges of said first web to said garment adjacent said opposite edges of said opening so that said first web can permit limited separation of said opposite edges of said opening, a second flexible web at least a portion of which is of air-pervious material, and means for attaching said second web to said garment at a location on either side of said opening and spaced from said opposite edges of said opening, whereby when said closure is opened the portion of said garment between said last-mentioned attaching means can be distended by air traveling relatively toward said garment to define an intake scoop to receive said air, and air so received in said scoop can discharge through said second web into the interior of said garment for providing ventilation.

16. A device as recited in claim 15 in which said scoop includes a free outer edge, and including means for covering said free outer edge when said closures means is closed, for thereby preventing entry of air.

17. A device as recited in claim 16 in which for said means for covering said free outer edge a flap is provided, said flap being extendable over said free outer edge, and including releasable fastener means for holding said flap over said free outer edge.

18. A device as recited in claim 17 in which said second web is provided with fastener means thereon, and in which said fastener means of said flap can engage said fastener means of said second web for causing said flap to overlie said second web so as to leave said free outer edge unconfined and allow the outer edge of said scoop to open.

* * * * *